US005765227A

United States Patent [19]

Wright

[11] Patent Number: 5,765,227

[45] Date of Patent: Jun. 16, 1998

[54] BOLO TIE AND METHOD OF FABRICATION

[76] Inventor: Alfred T. Wright, 163 Shrewsbury Ave., Red Bank, N.J. 07701

[21] Appl. No.: 927,342

[22] Filed: Sep. 11, 1997

[51] Int. Cl.[6] ..... A41D 25/04

[52] U.S. Cl. ..... 2/144; 2/145; 2/152.1; 24/66.9; 24/115 M

[58] Field of Search ..... 2/144, 145, 146, 2/147, 148, 149, 150, 151, 152.1, 153, 154, 155, 156, 157, 52, 338, 341; 24/59, 62, 66.9, 66.11, 70 J, 68 J, 115 M, 115 H; 63/1.11, 1.6, 3.2, 14.7, 18, 26

[56] References Cited

U.S. PATENT DOCUMENTS

| | | | |
|---|---|---|---|
| D. 344,850 | 3/1994 | Galmines . | |
| 534,946 | 2/1895 | Bates . | |
| 1,891,947 | 12/1932 | Powell . | |
| 2,637,884 | 5/1953 | Morehouse . | |
| 2,832,116 | 4/1958 | Chevelt, Jr. et al. . | |
| 2,846,688 | 8/1958 | Meeker . | |
| 2,890,459 | 6/1959 | Waterhouse . | |
| 3,323,324 | 6/1967 | Bohlinger et al. . | |
| 3,347,037 | 10/1967 | Klang . | |
| 3,364,500 | 1/1968 | Fox . | |
| 3,453,698 | 7/1969 | Mosby . | |
| 3,481,155 | 12/1969 | Cook . | |
| 3,675,277 | 7/1972 | Day . | |
| 3,813,737 | 6/1974 | Larsen . | |
| 4,049,357 | 9/1977 | Hamesch, Jr. . | |
| 4,237,702 | 12/1980 | Caverly . | |
| 4,530,221 | 7/1985 | Weinberg . | |
| 4,754,534 | 7/1988 | Helwick . | |
| 4,912,814 | 4/1990 | McKenzie . | |
| 5,008,981 | 4/1991 | Smithson | 2/49 R |
| 5,195,335 | 3/1993 | Hart . | |
| 5,357,770 | 10/1994 | Lanyi | 63/29.1 |
| 5,416,925 | 5/1995 | Davis | 2/149 |
| 5,493,731 | 2/1996 | Amnolt | 2/148 |
| 5,664,297 | 9/1997 | Mandukian | 2/148 |

*Primary Examiner*—Jeanette E. Chapman

[57] ABSTRACT

A new bolo tie and method of fabrication for constructing a novel appearance of a bolo clasp. The inventive device includes a bolo clasp having a predetermined shape. The bolo clasp has a front portion and a rear portion. The front portion has an arcuate outer surface and a planar inner surface. The rear portion extends outwardly from the planar inner surface. The rear portion has a pair of apertures therethrough. The arcuate outer surface of the front portion has a recess formed therein. A layer of epoxy is disposed within the recess. A decorative stone is secured within the recess by the layer of epoxy. A length of cord has opposed free ends received through the pair of apertures of the bolo clasp. A pair of agelets are secured to the free ends of the length of cord.

2 Claims, 2 Drawing Sheets

BOLO TIE AND METHOD OF FABRICATION

BACKGROUND OF THE INVENTION

Field of the Invention

The present invention relates to neckties and more particularly pertains to a new bolo tie and method of fabrication for constructing a novel appearance of a bolo clasp.

Description of the Prior Art

The use of neckties is known in the prior art. More specifically, neckties heretofore devised and utilized are known to consist basically of familiar, expected and obvious structural configurations, notwithstanding the myriad of designs encompassed by the crowded prior art which have been developed for the fulfillment of countless objectives and requirements.

Known prior art neckties include U.S. Pat. No. 4,912,814 to McKenzie; U.S. Pat. No. 3,187,396 to Carroll; U.S. Pat. No. 5,416,925 to Davis; U.S. Pat. No. 3,022,515 to Bornstein et al.; U.S. Pat. No. Des. 307,511 to Haines, Sr.; and U.S. Pat. No. 4,627,113 to Lord.

While these devices fulfill their respective, particular objectives and requirements, the aforementioned patents do not disclose a new bolo tie and method of fabrication. The inventive device includes a bolo clasp having a predetermined shape. The bolo clasp has a front portion and a rear portion. The front portion has an arcuate outer surface and a planar inner surface. The rear portion extends outwardly from the planar inner surface. The rear portion has a pair of apertures therethrough. The arcuate outer surface of the front portion has a recess formed therein. A layer of epoxy is disposed within the recess. A decorative stone is secured within the recess by the layer of epoxy. A length of cord has opposed free ends received through the pair of apertures of the bolo clasp. A pair of agelets are secured to the free ends of the length of cord.

In these respects, the bolo tie and method of fabrication according to the present invention substantially departs from the conventional concepts and designs of the prior art, and in so doing provides an apparatus primarily developed for the purpose of constructing a novel appearance of a bolo clasp.

SUMMARY OF THE INVENTION

In view of the foregoing disadvantages inherent in the known types of neckties now present in the prior art, the present invention provides a new bolo tie and method of fabrication construction wherein the same can be utilized for constructing a novel appearance of a bolo clasp.

The general purpose of the present invention, which will be described subsequently in greater detail, is to provide a new bolo tie and method of fabrication apparatus and method which has many of the advantages of the neckties mentioned heretofore and many novel features that result in a new bolo tie and method of fabrication which is not anticipated, rendered obvious, suggested, or even implied by any of the prior art neckties, either alone or in any combination thereof.

To attain this, the present invention generally comprises a bolo clasp having a predetermined shape. The bolo clasp has a front portion and a rear portion. The front portion has an arcuate outer surface and a planar inner surface. The rear portion extends outwardly from the planar inner surface. The rear portion has a pair of apertures therethrough. The arcuate outer surface of the front portion has a recess formed therein. A layer of epoxy is disposed within the recess. A decorative stone is secured within the recess by the layer of epoxy. A length of cord has opposed free ends received through the pair of apertures of the bolo clasp. A pair of agelets are secured to the free ends of the length of cord.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bolo tie and method of fabrication apparatus and method which has many of the advantages of the neckties mentioned heretofore and many novel features that result in a new bolo tie and method of fabrication which is not anticipated, rendered obvious, suggested, or even implied by any of the prior art neckties, either alone or in any combination thereof.

It is another object of the present invention to provide a new bolo tie and method of fabrication which may be easily and efficiently manufactured and marketed.

It is a further object of the present invention to provide a new bolo tie and method of fabrication which is of a durable and reliable construction.

An even further object of the present invention is to provide a new bolo tie and method of fabrication which is susceptible of a low cost of manufacture with regard to both materials and labor, and which accordingly is then susceptible of low prices of sale to the consuming public, thereby making such bolo tie and method of fabrication economically available to the buying public.

Still yet another object of the present invention is to provide a new bolo tie and method of fabrication which provides in the apparatuses and methods of the prior art some of the advantages thereof, while simultaneously overcoming some of the disadvantages normally associated therewith.

Still another object of the present invention is to provide a new bolo tie and method of fabrication for constructing a novel appearance of a bolo clasp.

Yet another object of the present invention is to provide a new bolo tie and method of fabrication which includes a bolo clasp having a predetermined shape. The bolo clasp has a front portion and a rear portion. The front portion has an arcuate outer surface and a planar inner surface. The rear portion extends outwardly from the planar inner surface. The rear portion has a pair of apertures therethrough. The arcuate outer surface of the front portion has a recess formed therein. A layer of epoxy is disposed within the recess. A decorative stone is secured within the recess by the layer of epoxy. A length of cord has opposed free ends received through the pair of apertures of the bolo clasp. A pair of agelets are secured to the free ends of the length of cord.

Still yet another object of the present invention is to provide a new bolo tie and method of fabrication that creating an eye-catching and captivating accessory item.

Even still another object of the present invention is to provide a new bolo tie and method of fabrication that could be produced in a wide array of shapes and ornamented with various stones.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
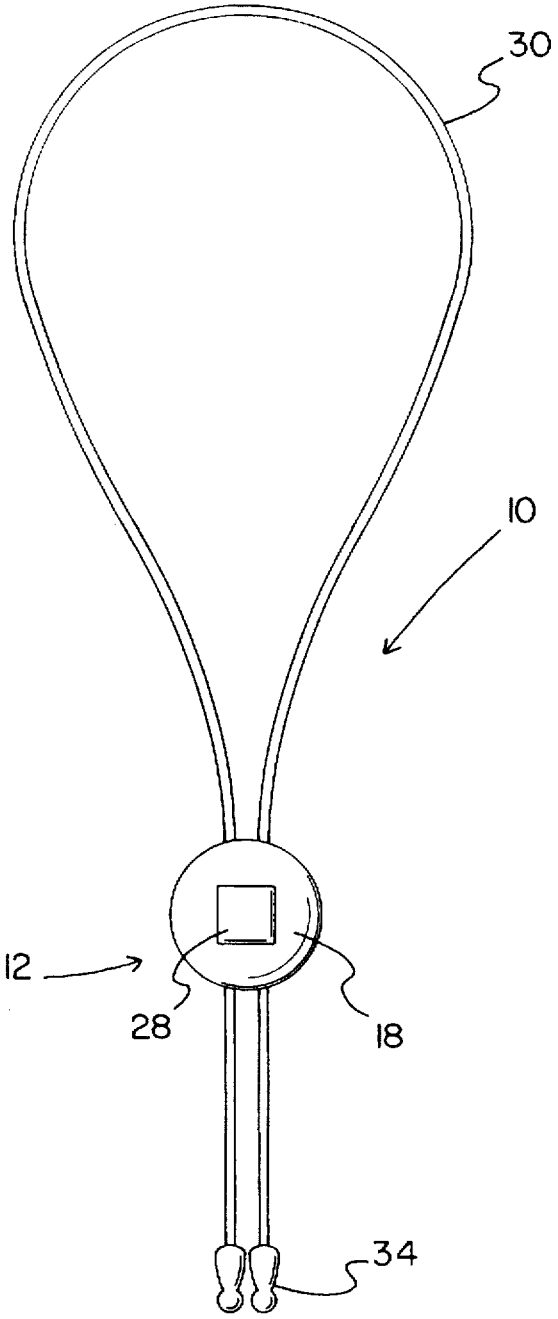
FIG. 1 is a front view of a new bolo tie and method of fabrication according to the present invention.
Figure 2:
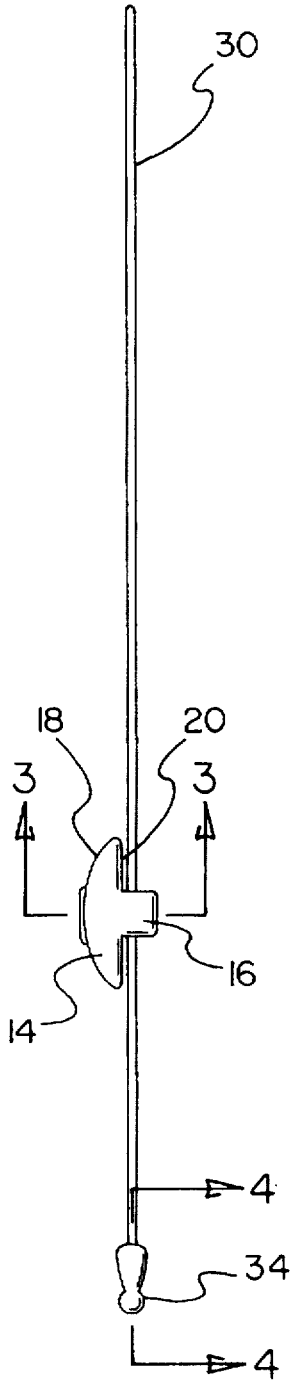
FIG. 2 is a side view of the present invention.
Figure 3:
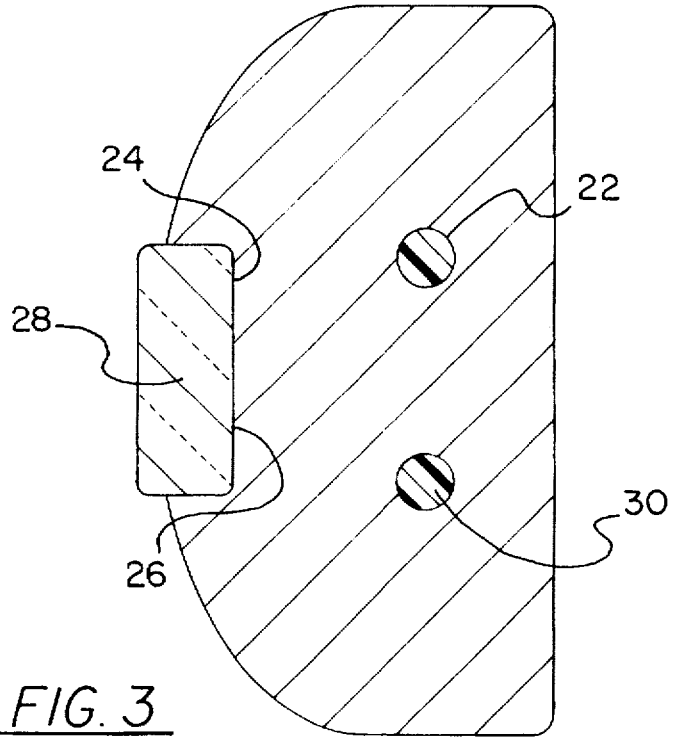
FIG. 3 is a cross-sectional view of the present invention as taken along line 3—3 of FIG. 2.
Figure 4:
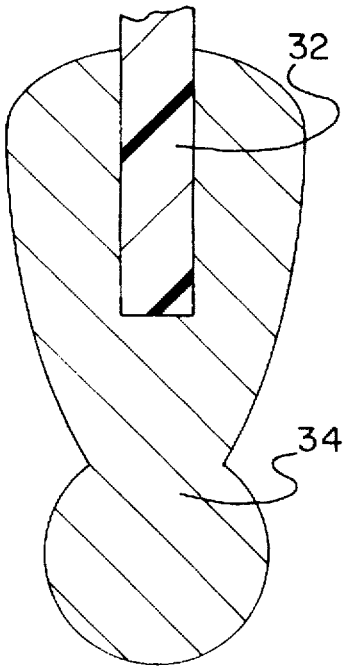
FIG. 4 is a cross-sectional view of the present invention as taken along line 4—4 of FIG. 2.

With reference now to the drawings, and in particular to FIGS. 1 through 4 thereof, a new bolo tie and method of fabrication embodying the principles and concepts of the present invention and generally designated by the reference numeral 10 will be described.

As best illustrated in FIGS. 1 through 4, the bolo tie and method of fabrication 10 comprises a bolo clasp 12 having a predetermined shape. The bolo clasp 12 has a front portion 14 and a rear portion 16. The front portion 14 has an arcuate outer surface 18 and a planar inner surface 20. The rear portion 16 extends outwardly from the planar inner surface 20. The rear portion 16 has a pair of apertures 22 therethrough. The arcuate outer surface 18 of the front portion 14 has a recess 24 formed therein.

A layer of epoxy 26 is disposed within the recess 24.

A decorative stone 28 is secured within the recess 24 by the layer of epoxy 26.

A length of cord 30 has opposed free ends 32 received through the pair of apertures 22 of the bolo clasp 12.

A pair of agelets 34 are secured to the free ends 32 of the length of cord 30.

The bolo clasp 12 and the agelets 34 are produced from mahogany or walnut. The bolo clasp 12 could be produced in a wide array of shapes and ornamented with various stones. The rear portion 16 of the bolo clasp 12 juts out from the front portion 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new bolo tie and method of fabrication for constructing a novel appearance of a bolo clasp comprising, in combination:

a bolo clasp having a predetermined shape, the bolo clasp having a front portion and a rear portion, the front portion having an arcuate outer surface and a planar inner surface, the rear portion extending outwardly from the planar inner surface, the rear portion having a pair of apertures therethrough, the arcuate outer surface of the front portion having a recess formed therein;

a layer of epoxy disposed within the recess;

a decorative stone secured within the recess by the layer of epoxy;

a length of cord having opposed free ends received through the pair of apertures of the bolo clasp; and a pair of agelets secured to the free ends of the length of cord.

2. A method of fabrication for constructing a novel appearance of a bolo clasp comprising, in combination:

providing a block of wood for carving into a bolo clasp having a predetermined shape, the bolo clasp having a front portion and a rear portion, cutting the front portion into an arcuate outer surface and a planar inner surface boring a pair of apertures through the rear portion;

cutting a recess in the arcuate outer surface of the front portion;

providing a layer of epoxy disposed within the recess;

providing a decorative stone for securement within the recess by the layer of epoxy;

providing a length of cord having opposed free ends received through the pair of apertures of the bolo clasp; and providing a piece of wood for carving into a pair of agelets secured to the free ends of the length of cord.

* * * * *